US005532717A

United States Patent [19]

Jones et al.

[11] Patent Number: 5,532,717

[45] Date of Patent: Jul. 2, 1996

[54] METHOD OF DISPLAYING TIME SERIES DATA ON FINITE RESOLUTION DISPLAY DEVICE

[75] Inventors: Gregory B. Jones, Tiverton, R.I.; Joseph B. Lopes, Seekonk, Mass.; Gerald R. Martel, Middletown, R.I.

[73] Assignee: The United States of America as represented by the Secretary of the Navy, Washington, D.C.

[21] Appl. No.: 246,901

[22] Filed: May 19, 1994

[51] Int. Cl.[6] ..... G09G 5/00

[52] U.S. Cl. ..... 345/202; 345/213; 345/132; 382/247; 395/114

[58] Field of Search ..... 345/202, 213, 345/132; 382/232, 247, 299; 348/568; 358/426; 364/715.02; 395/114

[56] References Cited

U.S. PATENT DOCUMENTS 4,359,608 11/1982 Watson et al. ..... 395/2.1
4,764,975 8/1988 Inoue ..... 382/299
5,214,580 5/1993 Aparo ..... 364/413.01
5,255,365 10/1993 Hurgerbuler ..... 382/232

*Primary Examiner*—Richard Hjerpe
*Assistant Examiner*—Lun-Yi Lao
*Attorney, Agent, or Firm*—Michael J. McGowan; James M. Kasischke; Prithvi C. Lall

[57] ABSTRACT

The method of the present invention minimizes the time required to display a portion of a time sampled data file. A plurality of compressed data files are generated based on the time sampled data file. Each of the compressed data files is defined by a corresponding unique compression ratio such that each compressed data file contains fewer data points than the original time sampled data file. Each compressed data file characterizes the original time sampled data file. The compressed data files are stored in a data storage device for subsequent retrieval. A resolution factor is defined for each of the compressed data files. One of the compressed data files is then selected based on the resolution factor and the portion of the time sampled data file requested for display. The selected compressed data file is transferred from the data storage device to the display device.

10 Claims, 1 Drawing Sheet

METHOD OF DISPLAYING TIME SERIES DATA ON FINITE RESOLUTION DISPLAY DEVICE

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates generally to the displaying of data files, and more particularly to a method of displaying time series data on a finite resolution display device that is part of an interactive computer system where it is desirable to minimize the time required to display a portion of a data file.

(2) Description of the Prior Art

The graphing or plotting of large data files (e.g., time sampled data) on a display device (e.g., CRT screen, printer, etc.) is typically governed by the finite resolution of the display device. The resolution of the display device is defined by the display device's indivisible unit of display. For example, a CRT screen's resolution is expressed in pixels. Thus, if the resolution of a CRT screen is 1000×700 pixels and each column of pixels represents, for example, one instant in time, then only 1000 instants in time can be displayed at once. Since large data files typically contain more than 1000 data points, the data file must be compressed in order to be completely viewed on the CRT screen.

In terms of displaying time sampled data on a CRT screen, each column of pixels is "overplotted" with a number of data points from the data file in order to compress the data file with respect to time. Accordingly, much of the data is ignored or printed redundantly at the same column on the CRT screen. If it is necessary to display just a small portion of the data, i.e., "zoom in" fewer data points are used to overplot a column of pixels. However, the entire data file must still be processed. Since the transfer of large data files from a memory device to a display device is slow, each requested "zoom in" or "zoom out" causes a time delay at the display device. Such time delays are undesirable/unacceptable when it comes to interactive systems where an operator needs to zoom in and out on the data in order to analyze same.

SUMMARY OF THE INVENTION

Accordingly, it is an object of the present invention to provide a method of minimizing the time required to display a portion of a data file on a display device whose resolution is limited with respect to the amount of data in the data file.

Another object of the present invention is to provide a method of minimizing the time required to present large amounts of time sampled data or information on computer display devices used in an interactive computer system.

Still another object of the present invention is to provide a method of minimizing the time required for time sampled data to be displayed on a display device of an interactive computer system where the time sampled data is to be viewed over both small and large time intervals.

Other objects and advantages of the present invention will become more obvious hereinafter in the specification and drawings.

In an interactive computer system, a data file consisting of N data points sampled at sampling rate S over time period T is to be displayed on a finite resolution display device having a number of indivisible units of display P wherein N is greater than P. The method of the present invention minimizes the time required to display a portion of the data file where the portion is defined as a portion of time t of the time period T. A plurality of compressed data files are generated based on the data file. Each of the compressed data files is defined by a corresponding unique compression ratio R such that each compressed data file contains N/R data points that characterize the N data points. The compressed data files are stored in a data storage device for subsequent retrieval. A resolution factor (PR/S) is defined for each of the compressed data files. One of the compressed data files is then selected whose corresponding resolution factor is closest to and less than or equal to the portion of time t. The selected compressed data file is transferred from the data storage device to the display device.

BRIEF DESCRIPTION OF THE DRAWING(S)

Other objects, features and advantages of the present invention will become apparent upon reference to the following description of the preferred embodiments and to the drawings, wherein:

FIG. 1 is a functional block diagram of an interactive computer system used to carry out the method of the present invention; and FIG. 2 is a flow diagram of the method of the present invention.

DESCRIPTION OF THE PREFERRED EMBODIMENT(S)

Figure 1:
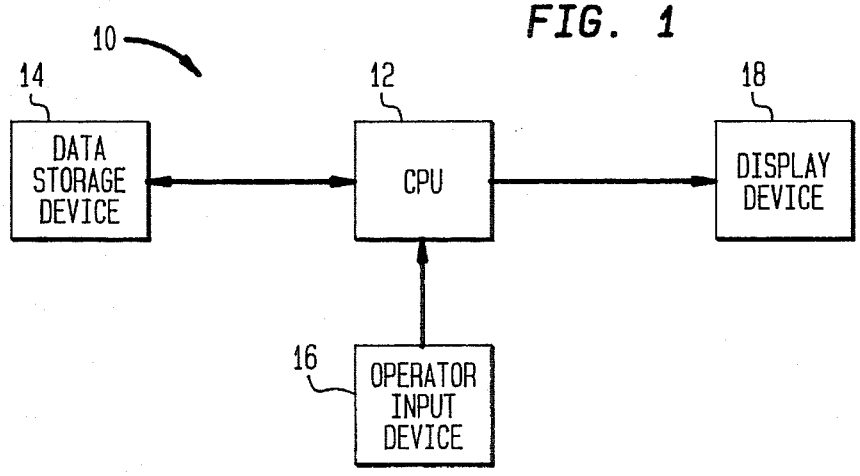

Referring now to the drawings, and more particularly to FIG. 1, a functional block diagram of an interactive computer system is shown and referenced generally by the numeral 10. Interactive computer system 10 includes a central processing unit (CPU) 12 interfaced with data storage device 14, operator input device 16 and display device 18. For purpose of illustration, it will be assumed that interactive computer system 10 is a conventional personal computer system, CPU 12 is any conventional processor, data storage device 14 is a conventional form of computer memory, operator input device 16 is a keyboard, and display device 18 is a CRT screen. Such systems and their operations are well known in the art and will not be addressed herein.

By way of example, it will be assumed that the data being manipulated by interactive computer system 10 is time sampled data stored in data storage device 14. The time sampled data is to be plotted against time on display device 18 in accordance with a select time interval input by an operator at operator input device 16. Finally, it will be assumed that the number of data points comprising the time sampled data greatly exceeds the resolution of display device 18.

Figure 2:
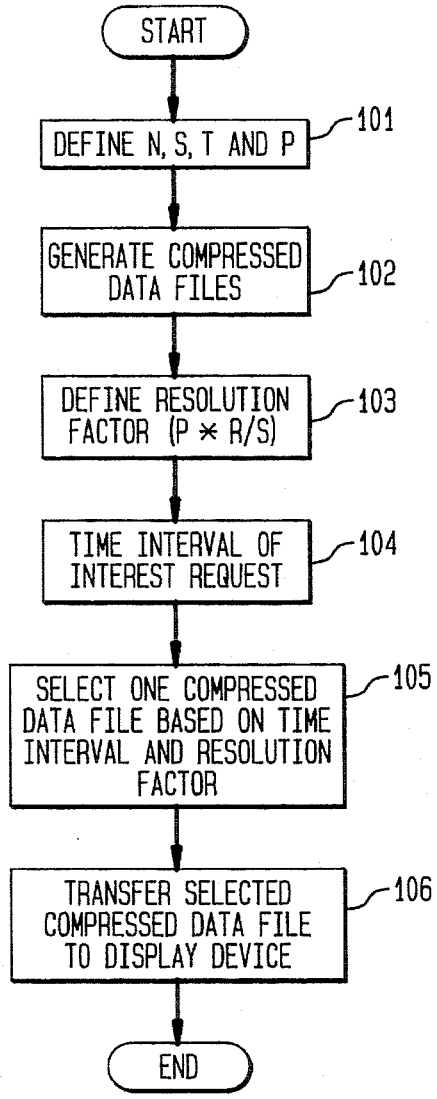

In FIG. 2, a flow diagram of the method of the present invention is shown. In block 101, the variables used by the present invention are defined. In particular, the time sampled data file to be displayed is stored in data storage device 14 and is defined as having N data points that have been sampled at sampling rate S for a length of time T. The number of indivisible units in the direction of what will be the time axis of display device 18 is defined as P. In block 102, CPU 12 generates a plurality of compressed data files using the time sampled data file stored in data storage device 14. Each of the compressed data files is a uniquely sized compressed version of the time sampled data file. Thus, each compressed data file has a corresponding compression ratio R defined as N divided by the resulting number of data points in the corresponding compressed data file. The resulting compressed data files can be stored in data storage device 14 until such time that they are required for display.

The particular choice of compression technique is not a limitation of the present invention. Indeed, the choice of compression technique can include a simple mathematical averaging technique, one of the many minimum/maximum compression techniques, logical combination compression techniques, or some combination thereof. Examples of possible compression techniques are disclosed in U.S. Pat. Nos. 5,214,580 and 5,255,365. (Note, however, that mean, mode, median or rms values are generally not suitable for time sampled data since transient data is averaged out.) It is only necessary that the compression technique maintain the character of the original time sampled data file regardless of the amount of compression.

As will be explained further below, the number of compressed data files used by the present invention is related to the amount of time required to display the data on display device 18. However, the more compressed data files that are generated, the greater the storage demands on data storage device 14. One way of determining the number of compressed files, f, is in accordance with the relationship $$f=\frac{\log_{10}\frac{N}{P}}{\log_{10}Q} \tag{1}$$

where Q is a fixed ratio factor between successively sized compressed data files. If using such successively sized compressed data files, the compression ratio R relating the compressed data files to the time sampled data file is defined as $Q^m$ where Q is greater than 1 and m is equal to 0, 1, 2, . . . , M where M is the number of compressed data files. An alternative to using the relationship in equation (1) is to generate a minimal number (e.g., 2 or 3) uniquely sized compressed data files.

Once the compressed data files are generated and stored in data storage device 14, a resolution factor is determined in CPU 12 as shown by block 103. The resolution factor for each of the compressed data files is determined using the value P defining the number of indivisible units of display device 18, the particular compressed data file's compression ratio R and the sampling rate S of the time sampled data file. More specifically, the resolution factor for each compressed data file is defined as $$\frac{PR}{S} \tag{2}$$

The resolution factor defines what portion of the sampling period can be displayed on the screen at any one time. Thus, in terms of time sampled data, the resolution factor has the units of "seconds of sampling period per screen display".

At block 104, an operator inputs a time interval of interest t via operator input device 16. Time interval t represents a time interval defining a portion of the time sampled data file that is to be displayed on display device 18. However, rather than processing the entire time sampled data file, the method of the present invention selects one of the compressed data files based on time interval t and the resolution factors for the compressed data files. In particular, at block 105, CPU 12 compares time interval t with each resolution factor to select the compressed data file whose resolution factor is closest to and less than or equal to time interval t. In other words, the compressed data file selected for display satisfies the relationship $$\left(\frac{PR}{S}\right)\leqq t \tag{3}$$

and further has its resolution factor closest to time interval t. The selected compressed data file is then transferred at block 106 from data storage device 14 to display device 18 by CPU 12 in accordance with well known data plotting techniques.

In order to provide a clearer understanding of the present invention and its advantages, an example is provided below. Consider a time sampled data file consisting of a single analog parameter, e.g., the depth of an underwater vehicle in feet. Assume further that this data parameter is sampled at a sampling rate S=100 samples/second for a period of time T=6 hours. Thus, the total number of data points N=2,160,000. For purpose of the example, the display device is a CRT screen capable of displaying 500 points along what would serve as the time axis of the screen. Thus, P=500 in terms of the present invention. Finally, select a fixed ratio factor Q=8. Applying equation (1) suggests the generation of four compressed data files. The particular compression technique is applied using the particular compression ratio R to generate the compressed data files having the number of data points as indicated below.

| File | Compression Ratio R | File Size | Resolution Factor |
|---|---|---|---|
| Original | 1 | 2,160,000 | 5 |
| 1 | 8 | 270,000 | 40 |
| 2 | 64 | 33,750 | 320 |
| 3 | 512 | 4,218 | 2560 |
| 4 | 4096 | 527 | 20,480 |

Note that equation (1) suggests the number of compressed data files such that the smallest size compressed data file, i.e., Compressed File No. 4, has at least as many data points as the particular value for P defining the number of indivisible units of the particular display device. Thus, in general, compressed data files are generated such that the file size or N/R is always greater than or equal to P.

As mentioned above, selection of the compressed data file for display is predicated on the time interval of interest. Continuing with the particulars of the illustrative example, assume that the data spanning from 1 hour to 1.5 hours in the sampling period is requested for display via operator input device 16. This corresponds to 0.5 hours of data or 180,000 (2,160,000*0.5/6) actual samples. Clearly 180,000 samples cannot fit on a CRT screen where P=500 without overplotting 360 (180,000/500) points for each pixel column. To alleviate the time associated with such overplotting, the next step of the present invention is applied. In particular, the time interval of interest, or t=0.5 hours=1800 seconds, is compared with the various resolution factors of the compressed data files. The (compressed data) File No. 2 is selected since its resolution factor is closest to t=1800 while being less than or equal to t. The result is that each pixel column need only overplot approximately 6 (1800/320) data points. When this is compared with the need to overplot 360 data points per pixel column, it is apparent that the present invention can display File No. 2 sixty times faster than if the original time sampled data file were used.

Since the fixed ratio factor Q=8, the time required for similar plots can vary by 8 times as much. For example, the plot for t=319 seconds would take eight times as long as the plot for t=320 seconds since different compressed data files would be used. This differential can be reduced by using a smaller fixed ratio factor Q. Once again however, the trade-off is the number of compressed data files that must be generated/stored. Balancing these two criteria has shown that Q=4 is optimum for most scenarios.

The advantages of the present invention are numerous. For an interactive system, the present invention minimizes the time required to display a portion of a time sampled data file by merely providing storage space for a plurality of compressed data file versions of the time sampled data file. Since the files need never be decompressed, a wide variety of compression techniques can be employed.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. In a computer system, a method of minimizing display time for a data file, comprising the steps of:

generating a plurality of compressed data files based on said data file, said data file consisting of N data points sampled at sampling rate S over time period T, each of said plurality of compressed data files being defined by a corresponding unique compression ratio R and each of said plurality of compressed data files containing N/R data points that characterize said N data points;

storing said plurality of compressed data files in a data storage device;

defining a resolution factor (PR/S) for each of said plurality of compressed data files, wherein P is the number of indivisible units of display of a finite resolution display device and wherein N>P;

selecting one of said plurality of compressed data files whose corresponding one of said resolution factors is closest to and less than or equal to a selected portion of time t from said time period T; and transferring said one of said plurality of compressed data files from said data storage device to said display device.

2. A method according to claim 1 wherein said compression ratio R for said plurality of compressed data files is defined by a series $Q^m$ where Q is greater than 1 and m equals 1, 2, . . . , M.

3. A method according to claim 2 wherein Q is equal to 4.

4. A method according to claim 1 wherein, for each of said plurality of compressed data files, N/R is greater than or equal to P.

5. A method according to claim 2 wherein, for each of said plurality of compressed data files, N/R is greater than or equal to P.

6. A method according to claim 5 wherein Q is equal to 4.

7. A method according to claim 2 wherein said plurality of compressed data files comprises $(\log_{10} (N/P)/\log_{10} Q)$ compressed data files.

8. A method according to claim 1 wherein, for each of said plurality of compressed data files, each of said N/R data points is a mathematical compression of R data points.

9. A method according to claim 8 wherein said mathematical compression comprises a minimum/maximum compression technique.

10. A method according to claim 8 wherein said mathematical compression comprises an averaging compression technique.

* * * * *